US005105222A

United States Patent [19]

Ohta et al.

[11] Patent Number: 5,105,222

[45] Date of Patent: Apr. 14, 1992

[54] ELECTROPHOTOGRAPHIC COPYING APPARATUS HAVING PHOTOCONDUCTOR WITH MAGNETIC LAYER

[75] Inventors: Katsuichi Ohta, Mishima; Michio Kimura, Numazu; Kazuya Ishida, Numazu; Izumi Aiso, Numazu; Satoshi Igari, Numazu, all of Japan

[73] Assignee: Ricoh Company, Ltd., Tokyo, Japan

[21] Appl. No.: 645,795

[22] Filed: Jan. 25, 1991

[30] Foreign Application Priority Data

Jan. 29, 1990 [JP] Japan ..... 2-18599

[51] Int. Cl.[5] ..... G03G 5/00

[52] U.S. Cl. ..... 355/211; 355/296

[58] Field of Search ..... 355/211, 212, 296, 305, 355/215, 210; 430/39, 270, 275

[56] References Cited

U.S. PATENT DOCUMENTS

| | | | |
|---|---|---|---|
| 4,027,967 | 6/1977 | Euler | 355/212 X |
| 4,571,070 | 2/1986 | Tomita | 355/305 |
| 4,758,486 | 7/1988 | Yamazaki | 355/212 X |
| 4,772,253 | 9/1988 | Koizumi et al. | 355/212 X |
| 4,791,449 | 12/1988 | Foley et al. | 355/212 X |
| 4,975,745 | 12/1990 | Tanaka et al. | 355/211 |

*Primary Examiner*—A. T. Grimley
*Assistant Examiner*—Sandra L. Brase
*Attorney, Agent, or Firm*—Oblon, Spivak, McClelland, Maier & Neustadt

[57] ABSTRACT

An electrophotographic copying apparatus is provided with a belt-shaped photoconductor comprising. A magnetic electroconductive support and a photoconductive layer are formed on the photoconduction. A magnetic cleaning member is positioned for cleaning the surface of the belt-shaped photoconductor.

15 Claims, 5 Drawing Sheets

ELECTROPHOTOGRAPHIC COPYING APPARATUS HAVING PHOTOCONDUCTOR WITH MAGNETIC LAYER

BACKGROUND OF THE INVENTION

1. Field of the Invention

The present invention relates to an electrophotographic copying apparatus comprising a belt-shaped photoconductor member provided with a photoconductive layer, which is cleaned with a magnetic cleaning member having an improved cleaning efficiency, thereby attaining extended life of the belt-shaped photosensitive member.

2. Discussion of Background

In recent years, the practical application of electrophotography to printers for office copying machines and for various types of data processing terminal devices, including data transmission systems for facsimile and the like, and also for printing systems, has developed rapidly because of the simplicity of the systems, the high speed of data handling and the high quality of the images produced.

The electrophotographic copying apparatus which forms images basically uses an electrophotographic photoconductor comprising an electroconductive support and a photoconductive layer formed thereon. The electrophotographic copying process is as follows:

First, the surface of a photoconductor is uniformly charged by means of a charging device, and light which is modulated with respect to time and space to correspond to the data to be recorded in image form is directed onto the surface of the photoconductor so that an electrostatic charge pattern corresponding to the data, which is referred to as the latent electrostatic image, is formed. A corona discharge device utilizing a comparatively simple and stable corona discharge is generally used as the charging device. The electrostatic charge pattern is then developed using colored, charged toner particles, which may be simply referred to as the toner. Specifically, the toner is deposited on the surface of the photoconductor through the attraction or repulsion of the charged toner particles, so that a visible toner image is formed to correspond to the electrostatic charge pattern. Following this, the toner image is transferred to a recording medium such as a transfer sheet or the like. The transfer is generally implemented by providing, on the transfer paper, a corona charging of a polarity opposite to the polarity of the charged toner. The transferred toner image is fixed on the surface of the transfer sheet by some means such as by the application of heat or the like. On the other hand, the untransferred toner and a very fine paper dust which comes from the transfer sheet remain on the surface of the photoconductor. This mixture of toner and paper dust on the surface of the photoconductor is a drawback because when the next data is recorded, streaks and spots from this source occur on the image. It is therefore necessary to remove this toner and paper dust from the surface of the photoconductor using a specified cleaning member.

In a conventional cleaning method for removing the residual toner and paper dust from the surface of the photoconductor, (i) a blade made of a high molecular organic rubber such as urethane or the like, which is brought into pressure contact with the surface of the photoconductor, or (ii) a fur brush which comprises a metal roller made of, for example, aluminum, and nylon fibers which are fixed to the surface of the metal roller by use of an adhesive to form a brush thereon, which are rotated in contact with the surface of the photoconductor, is employed.

In this conventional cleaning method, the cleaning member, such as the blade or the brush roller, is pressed against the surface of the photoconductor by a mechanical means only, so that in the case where the photoconductor is in the form of a belt, it is difficult to press the cleaning member uniformly against the surface of the photoconductor. Because of this problem, there is a tendency for some parts of the photoconductor to be unsatisfactorily cleaned, and the deposition of toner on the background of the recorded image takes place.

As a method of eliminating these drawbacks, a method which enhances the cleaning effect is proposed in Japanese Laid-Open Utility Model Application 60-135757, in which a magnetic cleaning member with a built-in magnet, and a belt-shaped photoconductor provided with a magnetic member at the back side of the photoconductor are employed. In this method, the magnetic cleaning member is magnetically attracted to the magnetic member via the belt-shaped photoconductor, and therefore is pressed uniformly against the belt-shaped photoconductor.

The cleaning effect from using the method disclosed in the Japanese Laid-Open Utility Model Application 60-135757 is high in comparison with that obtained from using a method in which pressure is applied by mechanical means only. However, in this cleaning method, the undersurface portion of the belt-shaped photoconductor, that is, the electroconductive support portion, is abraded by the the magnetic member which is positioned on that undersurface of the photoconductor so that there is the problem that the particles formed by the abrasion from the electroconductive support scatter, and when the particles get between the belt-shaped photoconductor and the belt support and drive rollers, cracks appear in the photoconductive layer and white spots appear on the recorded image.

In the above method, the pressure applied by the cleaning member against the photoconductor can be enhanced. However, this pressure is not uniform in the width direction of the belt-shaped photoconductor, so that when a large number of copies are made, the problem of localized wear of the photoconductive layer occurs. When this type of localized wear occurs on the photoconductive layer, not only a drop in image density, but also toner deposition on the background of the image occurs, which is due to a localized drop in the initial development potential.

Furthermore the life expectancy of the belt-shaped photoconductor is shortened as a result of abrasion on the undersurface of the belt-shaped photoconductor, that is, the electroconductive support portion, and the wear on the photoelectroconductive layer.

SUMMARY OF THE INVENTION

Accordingly, an object of the present invention is to provide, with due consideration to the drawbacks of such conventional cleaning methods, an electrophotographic copying apparatus comprising a belt-shaped photoconductor comprising a photoconductive layer and an electroconductive support for supporting the photoconductive layer thereon, and a cleaning device for cleaning the photoconductor, with improved cleaning efficiency, Wherein abrasion in the electroconductive support and non-uniform wear of the photoconductive layer do not occur.

The above object of the present invention is achieved by an electrophotographic copying apparatus provided with (a) a belt-shaped photoconductor comprising a photoelectroconductive layer and a magnetic electroconductive support on which the photoconductive layer is formed, and (b) a magnetic cleaning member for cleaning the surface of the belt-shaped photoconductor.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3(*b*) shows the chemical structural formula of a charge transporting material;

DESCRIPTION OF THE PREFERRED EMBODIMENTS

Referring now to the accompanying drawings, the electrophotographic copying apparatus according to the present invention will now be explained.

Figure 1A:
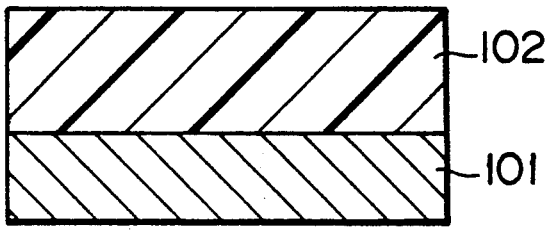
FIG. 1(*a*) and FIG. 1(*b*) are schematic illustrations showing the structures of belt-shaped photoconductors for use in the present invention.
Figure 1B:
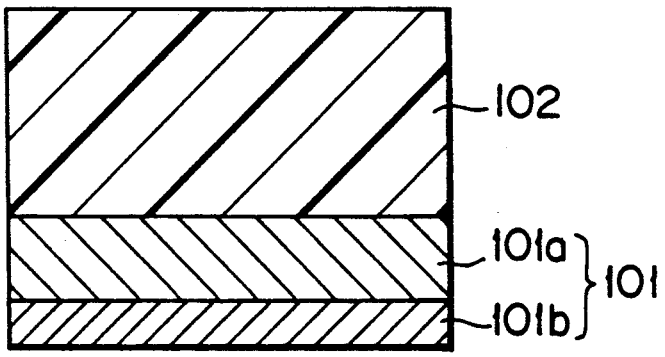

A belt-shaped photoconductor for use in the present invention comprises a magnetic electroconductive support 101 and a photoconductive layer 102 formed on the magnetic electroconductive support 101 as shown in in FIG. 1(*a*) and FIG. 1(*b*).

As the magnetic electroconductive support 101 used in the present invention any magnetic electroconductive supports can be employed as long as they have a structure which becomes magnetized in the presence of a magnetic field, for example, (*b*) a structure containing a magnetic material dispersed in a non-magnetic material; (2) a structure formed from a magnetic material; (3) a structure formed from (a) a non-magnetic film and (b) a magnetic film in which a magnetic material is dispersed therein.

Accordingly, (*b*) a support made of a metal which exhibits electroconductivity as well as ferromagnetism at room temperature, such as nickel, cobalt, iron, and the like, and alloys which include those metals, such as Co-Ni alloys, Ni-Cu alloys, Ni-Zn alloys, Fe-Ni alloys, formed in the form of a tube, using the DI method, the II method, by extrusion, by drawing, or the like, machined, and polished, then subjected to a surface treatment; and (2) a thin-film endless belt of the above-mentioned nickel, cobalt, and iron, and magnetic alloys containing those metals, made by electroforming, can be used as the magnetic electroconductive support 101.

Also, as shown in FIG. 1(*b*), in the case where the electroconductive support 101 is made of two layers—a non-magnetic electroconductive substrate (non-magnetic layer) 101*a* and a magnetic layer 101*b*, electroconductive metals such as aluminum, aluminum alloy, stainless steel, and the like, metals such as chromium, nichrome, palladium, copper, silver, gold, platinum, and the like, or metal oxides such as tin oxide, indium oxide, and the like, coated onto plastics such as polyethylene, polypropylene, polyethylene terephthalate or the like by deposition or sputtering, can be used as the non-magnetic electroconductive substrate 101*a*. A liquid formed by dissolving or dispersing tri-iron tetroxide in a solvent, together with a binder resin can be applied and dried to form a magnetic film, to be used as the magnetic layer 101*b*.

As the above-mentioned binder resin, thermoplastic resins such as polyamides, polyesters, copolymers of vinyl chloride and vinyl acetate, and thermosetting resins which are thermally polymerized from compounds containing a plurality of active hydrogens as in —OH group, —$NH_2$ group, —NH group, and the like, and compounds containing a plurality of isocyanate groups, and/or compounds containing a plurality of epoxy groups can be used. In this case, examples of the compounds containing a plurality of active hydrogen atoms which can be given are polyvinyl butyral, phenoxy resin, phenol resin, polyamide, polyester, polyethylene glycol, polypropylene glycol, polybutylene glycol, and acrylic resins containing active hydrogens, for example, active hydrogens as in hydroxyethyl methacrylate group, and the like. Examples which can be given of compounds containing a plurality of isocyanate groups include toluene diisocyanate, hexamethylene diisocyanate, diphenylmethane diisocyanate, and the like. Examples which can be given of compounds containing a plurality of epoxy groups include bisphenol A type epoxy resins and the like. In addition, photocurable resins which are combinations of resins with unsaturated bonds such as unsaturated polyurethane and unsaturated polyesters, and photopolymerization initiators such as thioxanthone-type compounds and methylbenzylformate can also be used as binder resins.

It is preferable that the ratio of the tri-iron tetroxide to the binder resin used in the present invention be in the range from 1:5 to 19:1 by weight, but for the greatest effect a range from 1:2 to 10:1 is more preferable, in view of the magnetic effect obtained and the binding among the particles of tri-iron tetroxide and the bonding between the magnetic layer 101*b* and the electroconductive substrate 101*a*. If the thickness of the magnetic layer 101*b* exceeds 0.5 μm, the required magnetic affect is still demonstrated, but the thicker the film the higher the cost of forming it. Accordingly, a suitable film thickness is considered to be in the range of about 1 μm to 20 μm.

As the photoconductive layer 102 used in the present invention, any electrophotographic photosensitive layers can be used so long as they can be electrically charged and are capable of retaining an electric charge therein. In particular, an organic photoconductive layer composed mainly of a flexible organic material is effective.

Examples of the organic photoconductive layer are: (*b*) an organic photoconductive layer formed as a charge-transfer complex by combining an electron donator compound and an electron acceptor compound (for example, as disclosed in U.S. Pat. No. 3,484,237); (2) an organic photoconductive layer sensitized by the addition of a dye to an organic photoconductor (for example, as disclosed in Japanese Patent Publication 48-25658); (3) an organic photoconductive layer which comprises a pigment and a positive-hole or electron-active matrix in which the pigment is dispersed (for example, as disclosed in Japanese Laid-Open Patent Application 47-30328 and Japanese Laid-Open Patent Application 47-18545); (4) a function-separated type organic photoconductive layer comprising a charge generation layer and a charge transport layer (for example, as disclosed in Japanese Laid-Open Patent Application No. 49-105537); (5) an organic photoconductive layer comprising as the main component is a eutectic complex of a dye and a resin (for example, as disclosed in Japanese Laid-Open Patent Application 47-10785); and (6) an organic photoconductive layer in which an organic pigment or an inorganic charge generating material is added to a charge transport complex (for example, as disclosed in Japanese Laid-Open Patent Application 49-105537).

Among these, the function-separated type photoconductive layer of (4) is applied in practice because it is possible to select a variety of materials in order to obtain high sensitivity and a desired function.

The charge generation layer is prepared by dispersing a charge generating material such as an azo pigment, a phthalocyanine pigment, an indigo pigment, a perylene pigment, a Se powder, a Se alloy powder, an amorphous silicon powder, a zinc oxide powder or a CdS powder in a resin binder such as polyester, polycarbonate, polyvinyl butyral, or acrylic resin to form a dispersion of the charge generating material and applying the dispersion to the surface of an electroconductive substrate. A thickness of about 0.01 to 2 μm is suitable for the charge generation layer.

The charge transport layer is formed by dissolving a charge transporting material such as an α-phenyl stilbene compound (Japanese Laid Open-Patent Application 58-198043), a hydrazone compound (Japanese Laid-Open Patent Application 55-46760) in a resin with film-forming capability to form a charge transport layer composition and applying the composition to the above-mentioned charge generation layer. The reason for dissolving the charge transporting material in such a film-forming resin is that the charge transporting material generally has a low molecular weight and has almost no film-forming capability on its own. Examples which can be given of such a film-forming resin include polyester, polysulfone, polycarbonate, types of polymethacrylic esters, polystyrene, and the like. A thickness of about 10 to 30 μm is suitable for the charge transport layer.

These organic photoconductive layers are formed by dissolving or dispersing the composition thereof in an organic solvent and applying the resulting coating liquid to the electroconductive support 101 in such a manner as to be overlaid thereon, using a blade, spray, immersion, nozzle, or roller method, or the like, followed by drying, to obtain the photoconductor.

Figure 2:
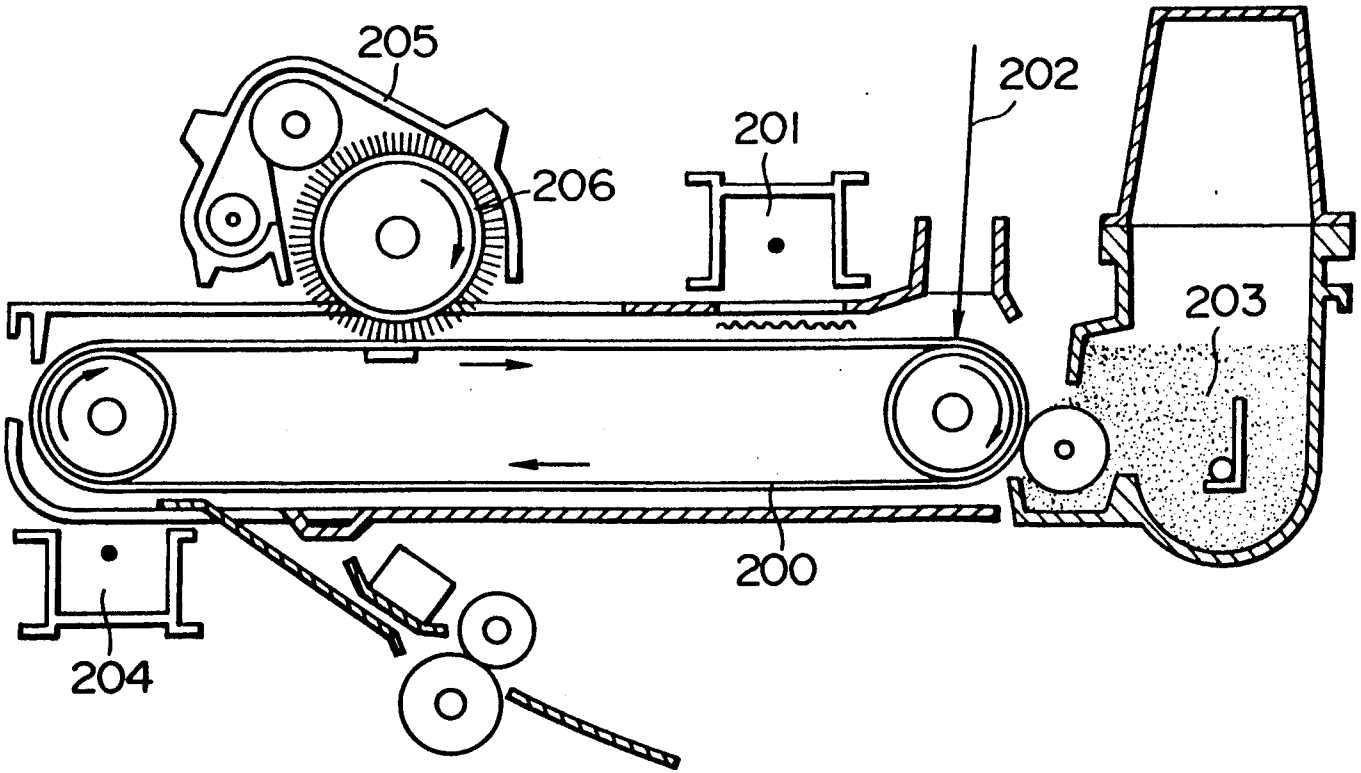
FIG. 2 is a schematic illustration of the structure of an electrophotographic copying apparatus of the present invention.

FIG. 2 is a schematic illustration of the structure of the electrophotographic copying apparatus of the present invention, provided with a laser printer in this case. In order to simplify the explanation, the figure shows only the configuration of the peripheral equipment for a belt-shaped photoconductor 200.

The belt-shaped photoconductor 200, as previously described, comprises a magnetic electroconductive support 101 (see FIG. 1(*a*) and FIG. 1(*b*)) and a photoconductive layer 102 formed thereon.

Around the belt-shaped photoconductor 200, there are provided a charger 201 which uniformly charges the belt-shaped photoconductor 200; a laser beam optical system (not shown) which projects a laser beam 202 containing image data onto the electric charge uniformly provided to the surface of the belt-shaped photoconductor 200 by a charger 201 to form a latent electrostatic image corresponding to the image data; a development unit 203 which develops the latent electrostatic image with toner to a visible toner image; an image transfer charger 204 which transfers the toner image onto a transfer sheet which is conveyed via a specified paper conveyor system; and a cleaning device 205 which removes toner and paper dust remaining on the belt-shaped photoconductor 200 when the copying has been completed. The cleaning device 205 is equipped with a magnetic cleaning fur-brush roller 206 with a built-in magnet. The transfer sheet on which the toner image transfer has been performed is guided on a specified guide plate, the toner image is fixed by means of an image fixing device (not shown), and the toner-image-bearing transfer sheet is then discharged from this copying system.

Other features of this invention will become apparent in the course of the following description of exemplary embodiments which are given for illustration of the invention and are not intended to be limiting thereof.

EXAMPLE 1

An electroconductive support 101 was fabricated in the form of a nickel belt (98% Ni content) with a thickness of 30 μm, a width of 250 mm, and a circumference of 350 mm, using an electroforming process.

A mixture of the following components was milled in a ball mill pot using alumina balls of 10 mm diameter for 24 hours:

| | |
|---|---|
| Titanium oxide (Trademark "TA-300", made by Fuji Titanium Industry Co., Ltd.) | 30 g |
| Alcohol-soluble copolymerized nylon (Trademark "CM8000" made by Toray Industries, Inc., methanol solution with 15.4% of solid components) | 130 g |
| Sodium polystyrene sulphonate (Trademark "C6120" made by Sanyo Chemical Industries, Ltd.) | 4 g |
| Ion exchanged water | 30 g |

To the above mixture, 175 g of a nylon copolymer was then added and milling was continued for an additional one hour. On completion of the milling, the mixture was diluted by the addition of 500 g of methanol and 460 g of 1-butanol, and stirred to provide an intermediate layer coating liquid.

The thus prepared intermediate layer coating liquid was applied to the electroconductive support 101 by spraying coating and dried at 150° C. for 20 minutes to form an intermediate layer with a thickness of 3.5 μm, which serves as a magnetic electroconductive layer.

Figure 3A:
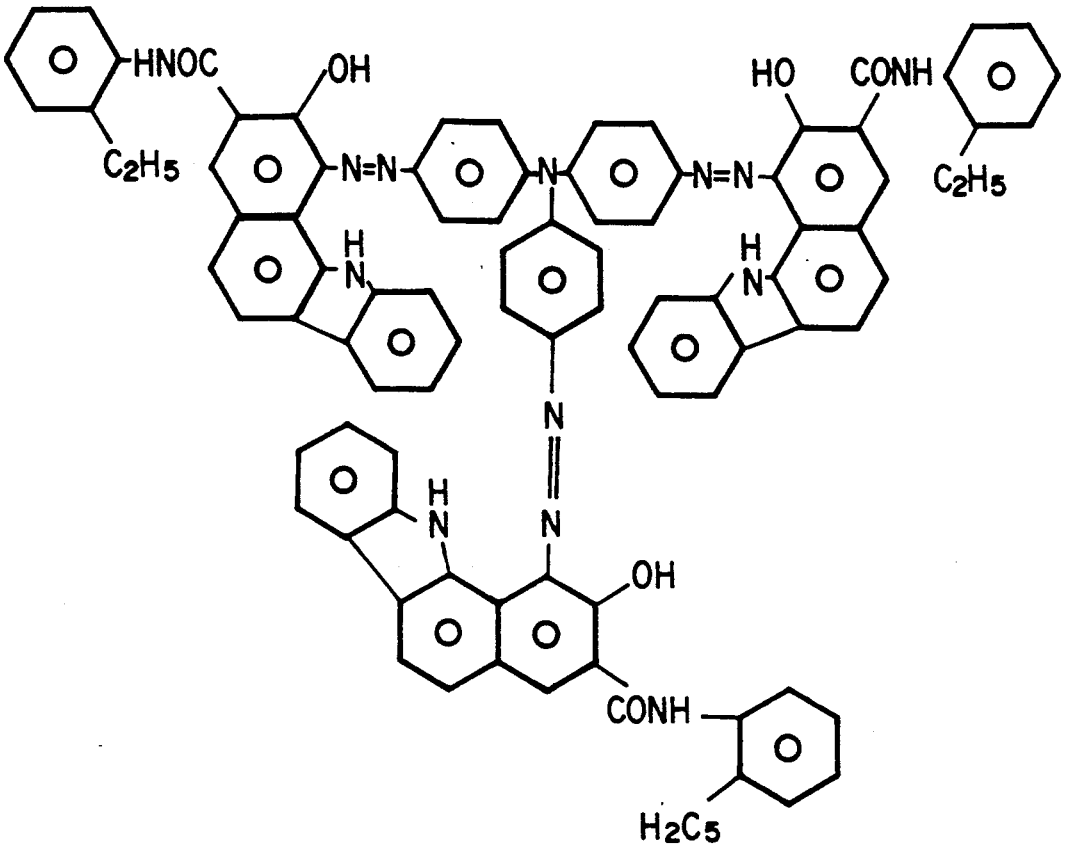
FIG. 3(*a*) shows the chemical structural formula of a trisazo pigment.
Figure 3B:
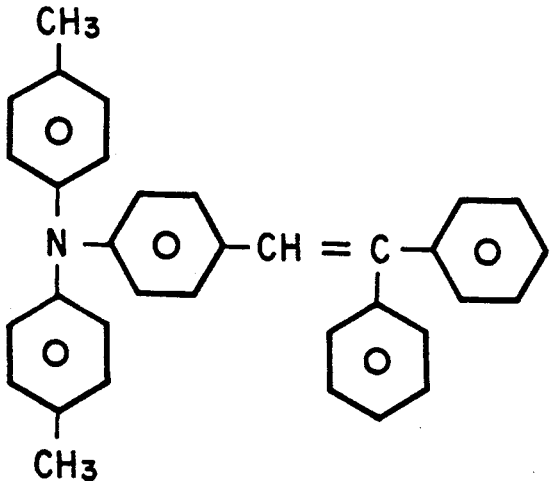

A mixture of the following components was subjected to ball milling, using a glass pot and agate balls with a diameter of 10 mm, for 48 hours:

| | |
|---|---|
| Trisazo pigment (compound shown in FIG. 3 (a)) | 12.5 g |
| Butyral resin (Trademark "XYHL" made by UCC Co., Ltd.) | 2.1 g |
| Cyclohexanone (made by Kanto Chemical Co., Ltd.) | 182.5 g |

On completion of the milling, 300 g of cyclohexanol was added to the above mixture and milling was continued for an additional one hour. Additional cyclohexanone was added to this milled mixture to obtain a charge generation layer coating liquid with a solid-component-concentration of 0.9 wt. % solid concentration.

The thus prepared charge generation layer coating liquid was applied by spraying coating onto the above coated intermediate layer and dried at 130° C. for 10 minutes, to form a charge generation layer with such a deposition of the charge generation layer that the reflectance of the photoconductive layer to be formed was 20% with respect to light with a wavelength of 780 nm.

A charge transport layer coating liquid with the following formulation was then prepared:

| | |
|---|---|
| Charge transporting material (compound shown in FIG. 3 (b)) | 7 g |
| Polycarbonate resin (Trademark "C1400" made by Teijin Chemicals Ltd.) | 10 g |
| Silicone oil (Trademark "KF50" made by Shin-Etsu Chemical Co., Ltd.) | 0.002 g |
| Tetrahydrofuran | 83 g |
| Cyclohexanone | 150 g |

The above charge transport layer coating liquid was applied by spraying coating onto the charge generation layer, then dried at 160° C. to obtain a charge transport layer with a thickness of 20 μm, whereby a belt-shaped photoconductor 200, which is referred to as belt-shaped photoconductor No. 1 for use in the present invention, was prepared.

The thus prepared belt-shaped photoconductor No. 1 was mounted on an electrophotographic copying apparatus equipped with a magnetic cleaning brush roller 206 as shown in FIG. 2, and a printing test was carried out. In the figure, reference numeral 200 indicates a belt-shaped photoconductor; reference numeral 201, a charger; reference numeral 202, a laser beam; reference numeral 203, a development unit; reference numeral 204, an image transfer charger; reference numeral 205, and a cleaning device.

Specifically, a Laser Printer LP4080 made by Ricoh Company, Ltd. was used as the electrophotographic copying apparatus, with the elimination of a magnetic member positioned on the opposite side to the magnetic cleaning roller of this apparatus. Even after 3000 sheets had been printed a clean print was still obtained, without any localized drop in image density and toner deposition o the background of the obtained images.

Figure 4:
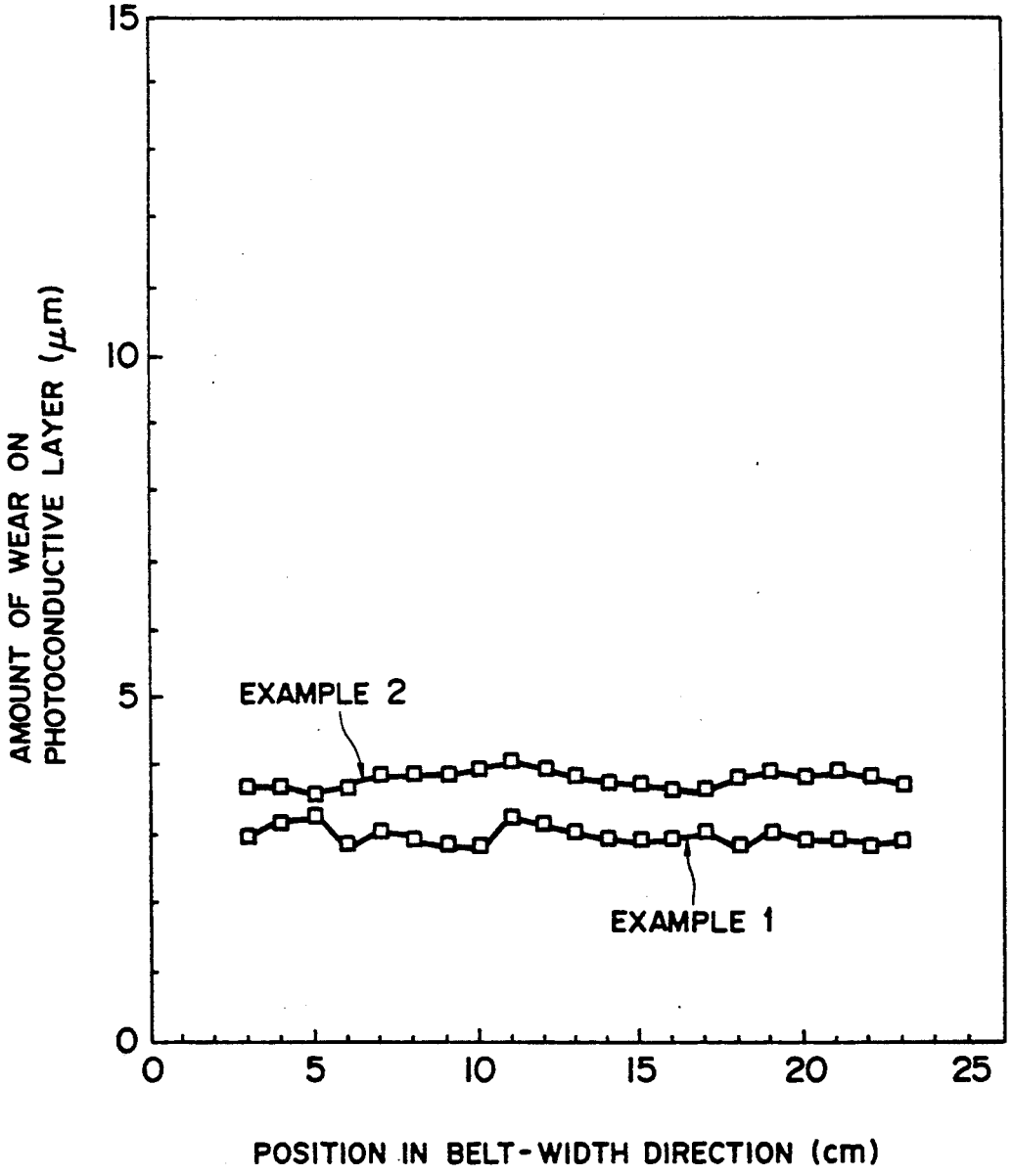
FIG. 4 is an explanatory diagram showing the amount of wear of a photoconductive layer in the width direction thereof in the respective belt-shaped photoconductors of Example 1 and Example 2 of the present invention.

The graph in FIG. 4 shows the amount of wear on the photoconductive layer 102 in the width direction of the belt-shaped photoconductor No. 1 prepared in Example 1 after 3000 sheets had been printed. As shown in the graph, on completion of the printing of 3000 sheets, uniform wear was seen on the photoconductive layer 102 in the width direction of the belt-shaped photoconductor No. 1.

EXAMPLE 2

The same intermediate layer and the same photoconductive layer as those prepared in Example 1 were formed on a magnetic iron belt with a thickness of 25 μm prepared by an electroforming process, using the same method as in Example 1, whereby a magnetic belt-shaped photoconductor 200, which is referred to as magnetic belt-shaped photoconductor No. 2 for use in the present invention, was fabricated.

In the same manner as for Example 1, the belt-shaped photoconductor No. 2 was mounted on the Ricoh Laser Printer LP4080 employed in Example 1 and the same printing test was carried out as in Example 1. The result was that even after 3000 sheets had been printed a clean print was still obtained, without any localized drop in image density and without toner deposition on the background of the obtained images.

The graph in FIG. 4 shows the amount of wear on the photoconductive layer 102 in the width direction of the belt-shaped photoconductor No. 2 after 3000 sheets had been printed. As shown in the graph, on completion of the printing of 3000 sheets, uniform wear was seen on the photoconductive layer 102 in the width direction of the magnetic belt-shaped photoconductor No. 2.

EXAMPLE 3

In a hardened glass pot with a diameter of 9 cm were placed a sufficient quantity of 1 cm diam sintered alumina balls to half fill the pot, 15.2 g of finely-divided tri-iron tetroxide particles (made by Sumitomo Cement Co., Ltd.), and 61 g of a methyl ethyl ketone solution of butyral resin (Trademark "BL-1" made by Sekisui Chemical Co., Ltd.) with a 3.5 wt % of solid component. The mixture was milled for 24 hours, then 9 g of a 7 wt % solution of toluene diisocyanate in methyl ethyl ketone were added and the mixture was agitated by shaking for about 5 minutes to obtain a magnetic layer coating liquid.

This magnetic layer coating liquid was applied by means of a blade to the undersurface of a polyester film 75 μm thick which had been made electroconductive by deposition of aluminum on its upper surface (hereinafter referred to as the electroconductive substrate 101*a*), and cured by drying at 120° C. for 30 minutes to form a magnetic layer 101*b* with a thickness of 5 μm.

In the same manner as in Example 1, the same intermediate layer and the same photoconductive layer 102 as in Example 1 were formed on the aluminum-evaporated surface of the electroconductive substrate 101*a* provided with the magnetic layer 101*b*, whereby a magnetic belt-shaped photoconductor 200 as shown in FIG. 1(*b*), which is referred to magnetic belt-shaped photoconductor No. 3 for use in the present invention, was fabricated.

In the course of the above-mentioned fabrication of the magnetic belt-shaped photoconductor No. 3, in particular, during the coating of each layer, both ends of the electroconductive support 101 were masked with a polyester film during the coating of the layers, and the uncoated sections of the intermediate layer and the photoconductive layer 102 were formed to a width of 230 mm. A black electroconductive coating formed from carbon and acrylic resin was applied to the uncoated sections and dried at 130° C. for 20 minutes to provide a black electroconductive layer for grounding.

The above material was cut to a specified size and welded ultrasonically to form the above-mentioned magnetic belt-shaped photoconductor No. 3 with a width of 250 mm and a circumference of 350 mm. A joint detection marker was then attached at a position 15 mm from the ultrasonic weld on the black electroconductive layer.

In the same manner as for Example 1, the belt-shaped photoconductor No. 3 was mounted on the Ricoh Laser Printer LP4080 employed in Example 1 and the same printing test was carried out as in Example 1. The result was that even after 3000 sheets had been printed a clean print was still obtained, without any localized drop in image density and without toner deposition on the background of the obtained images.

Figure 5:
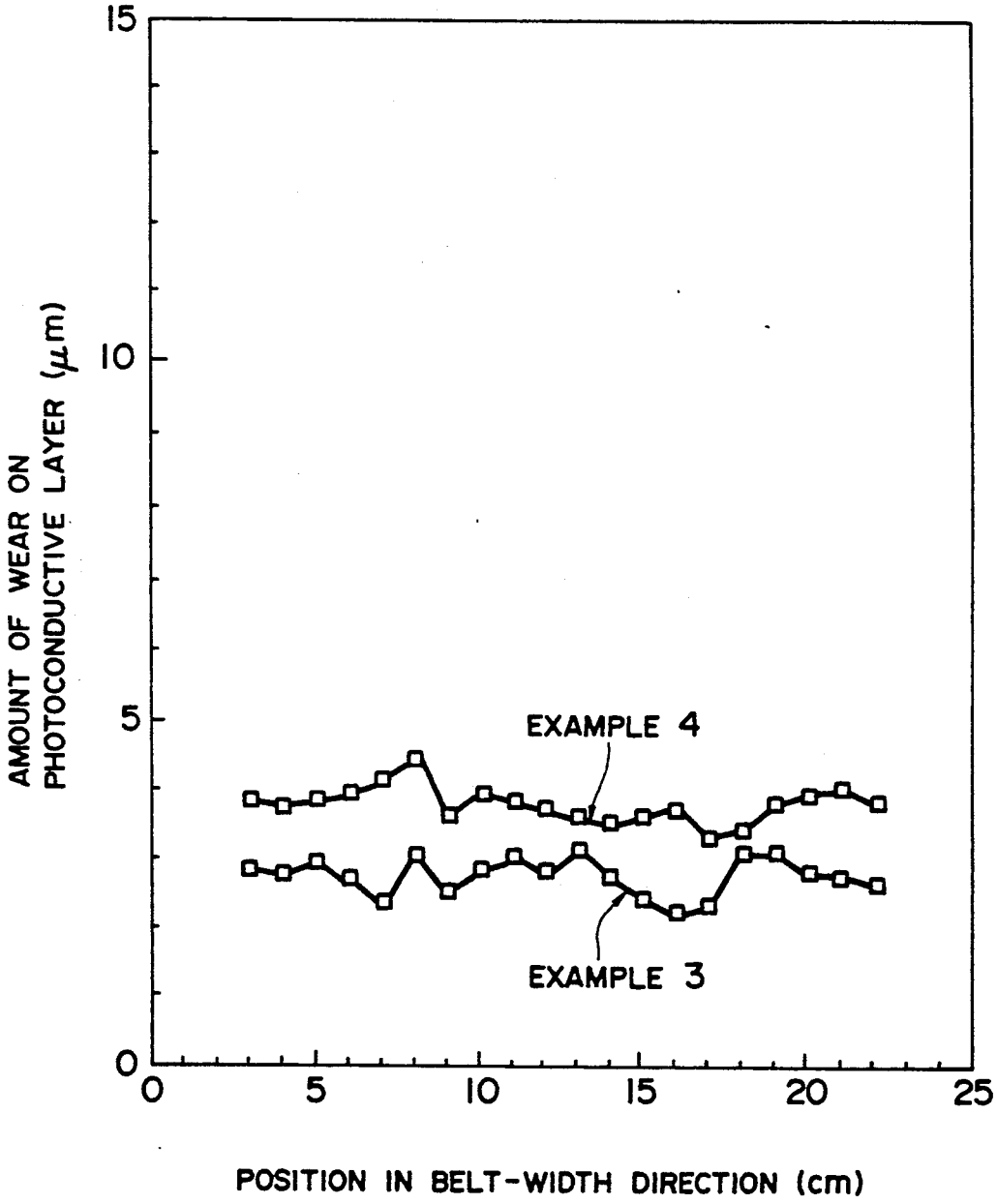
FIG. 5 is an explanatory diagram showing the amount of wear of a photoconductive layer in the width direction thereof in the respective belt-shaped photoconductors of Example 3 and Example 4 of the present invention.

The graph in FIG. 5 shows the amount of wear on the photoconductive layer 102 in the width direction of the belt-shaped photoconductor No. 3 after 3000 sheets had been printed. As shown in the graph, on completion of the printing of 3000 sheets, uniform wear was seen on the photoconductive layer 102 in the width direction of the magnetic belt-shaped photoconductor No. 3.

EXAMPLE 4

In a hardened glass pot with a diameter of 9 cm were placed a sufficient quantity of 1 cm diam sintered alumina balls to half fill the pot, 30 g of finely-divided tri-iron tetroxide particles (made by Sumitomo Cement Co., Ltd.), 35 g of a methanol solution of polyamide resin (Trademark "CM800" made by Toray Industries Inc.), and 35 g of n-butanol. The mixture was milled for 24 hours, whereby an undercoat layer coating liquid was prepared.

This undercoat layer coating liquid was applied by means of a blade to the undersurface of a 75 μm thick polyester film which had been made electroconductive by deposition of aluminum on its upper surface (hereinafter referred to as the electroconductive substrate 101*a*), and cured by drying at 120° C. for 30 minutes to form a magnetic layer 101*b* with a thickness of 10 μm.

In the same manner as in Example 1, the same intermediate layer and the same photoconductive layer 102 as in Example 1 were formed on the aluminum-evaporated surface of the electroconductive substrate 101*a*, whereby a magnetic belt-shaped photoconductor 200, which is referred to magnetic belt-shaped photoconductor No. 4 for use in the present invention was fabricated.

In the same manner as for Example 1, the belt-shaped photoconductor No. 4 was mounted on the Ricoh Laser Printer LP4080 employed in Example 1 and the same printing test was carried out as in Example 1. The result was that even after 3000 sheets had been printed a clean print was still obtained, without any localized drop in image density and without toner deposition on the background of the obtained images.

The graph in FIG. 5 shows the amount of wear on the photoconductive layer 102 in the width direction of the belt-shaped photoconductor No. 4 after 3000 sheets had been printed. As shown in the graph, on completion of the printing of 3000 sheets, uniform wear was seen on the photoconductive layer 102 in the width direction of the magnetic belt-shaped photoconductor No. 4.

As the results of Examples 3 and 4 in FIG. 5 clearly show, with the method using the magnetic belt-shaped photoconductor 200 of the present invention as in Examples 3 and 4, the amount of layer abrasion, that is, wear in the photoconductive layer 102, was small and was also uniform.

In addition, when the state of the wear on the underside, that is, the electroconductive support 101 portion of the belt-shaped photoconductor 200, was examined after the printing tests, there was no evidence of powder on the electroconductive support 101 in Examples 1 to 4.

As outlined in the foregoing explanation, the belt-shaped photoconductor provided with a photoconductive member on a magnetic electroconductive support of the present invention, in comparison with a conventional belt-shaped photoconductor which uses a non-magnetic electroconductive support, is subjected to a uniform pressure by the magnetic cleaning brush roller so that the cleaning is uniform, and the abrasion of the photoconductive layer is also uniform so that the drop in image density is extremely small and no toner deposition on the background of images takes place from localized wear. Accordingly, the life expectancy of the belt-shaped photosensitive can be increased.

We claim:

1. An electrophotographic copying apparatus comprising:

a belt-shaped photoconductor, said belt-shaped photoconductor comprising a magnetic electroconductive support and a photoconductive layer formed thereon, and a magnetic cleaning member positioned for cleaning the surface of said belt-shaped photoconductor.

2. The electrophotographic copying apparatus as claimed in claim 1, wherein said electroconductive support comprises a magnetic material.

3. The electrophotographic copying apparatus as claimed in claim 1, wherein said electroconductive support consists essentially of a magnetic material.

4. The electrophotographic copying apparatus as claimed in claim 1, wherein said electroconductive support comprises a non-magnetic layer and a magnetic layer comprising a magnetic material, which are overlaid on one another.

5. The electrophotographic copying apparatus of claim 4 wherein said non-magnetic layer comprises one from the group consisting of aluminum, aluminum alloy, stainless steel, chromium, nichrome, palladium, copper, silver, gold, platinum, tin oxide and indium oxide.

6. The electrophotographic copying apparatus of claim 4 wherein said non-magnetic layer consists of a metal oxide coated onto a plastic.

7. The electrophotographic copying apparatus of claim 6 wherein said plastic is one from the group consisting of polyethylene, polypropylene and polyethylene terephthalate.

8. The electrophotographic copying apparatus of claim 4 wherein said magnetic layer comprises a dried mixture of tri-iron tetroxide and a resinous binder.

9. The electrophotographic copying apparatus of claim 8 wherein said binder is one from the group consisting of polyamides, polyesters, copolymers of vinyl chloride and vinyl acetate, thermosetting resins, compounds containing a plurality of isocyanate groups, and compounds containing a plurality of epoxy groups.

10. The electrophotographic copying apparatus of claim 8 wherein the ratio of tri-iron tetroxide to binder is from 1:5 to 19:1 by weight.

11. The electrophotographic copying apparatus of claim 8 wherein the ratio of tri-iron tetroxide to binder is from 1:2 to 10:1 by weight.

12. The electrophotographic copying apparatus of claim 1 wherein said magnetic cleaning member is positioned facing said photoconductive layer.

13. The electrophotographic copying apparatus of claim 1 wherein said electrophotoconductive support is made from one from the group consisting of nickel cobalt and iron.

14. The electrophotographic copying apparatus of claim 1 wherein said electrophotoconductive support is made from one from the group consisting of alloys of nickel cobalt and iron.

15. The electrophotographic copying apparatus of claim 7 wherein said alloys comprise one from the group consisting of Co-Ni alloys, Ni-Cu alloys, Ni-Zn alloys and Fe-Ni alloys.

* * * * *